United States Patent [19]

Trützschler

[11] 4,297,766

[45] Nov. 3, 1981

[54] METHOD AND APPARATUS FOR FORMING FIBER MIXTURES

[75] Inventor: Hermann Trützschler, Monchen-Gladbach, Fed. Rep. of Germany

[73] Assignee: Trützschler GmbH & Co. KG, Mönchen-Gladbach, Fed. Rep. of Germany

[21] Appl. No.: 59,205

[22] Filed: Jul. 20, 1979

[30] Foreign Application Priority Data

Jul. 21, 1978 [DE] Fed. Rep. of Germany ..... 2832085

[51] Int. Cl.[3] ..... D01G 7/08; D01G 13/00

[52] U.S. Cl. ..... 19/80 R; 19/145.5

[58] Field of Search ..... 19/80 R, 80 A, 145.5, 19/145.7, 81

[56] References Cited

U.S. PATENT DOCUMENTS

| | | | |
|---|---|---|---|
| 3,443,285 | 5/1969 | Goldammer et al. | 19/81 |
| 3,577,599 | 5/1971 | Goldammer et al. | 19/145.5 |
| 3,806,990 | 4/1974 | Goldammer et al. | 19/145.5 |
| 3,978,552 | 9/1976 | Araki et al. | 19/80 R |

FOREIGN PATENT DOCUMENTS

| | | | |
|---|---|---|---|
| 2063415 | 6/1972 | Fed. Rep. of Germany | |
| 1685596 | 6/1978 | Fed. Rep. of Germany | |
| 2704240 | 8/1978 | Fed. Rep. of Germany | 19/81 |
| 2737434 | 1/1979 | Fed. Rep. of Germany | 19/81 |
| 2742016 | 3/1979 | Fed. Rep. of Germany | 19/80 R |

*Primary Examiner*—Louis Rimrodt

*Attorney, Agent, or Firm*—Spencer & Kaye

[57] ABSTRACT

A method of forming fiber mixtures from different kinds of fiber includes the step of removing the fiber in a plurality of passes from a plurality of stored fiber lots containing the different kinds of fiber. During each pass, fiber is removed from consecutive stored fiber lots in partial quantities that are small relative to the entire fiber quantities in the stored fiber lots. According to the method, prior to fiber removal in the first pass, the entire fiber quantity in each stored fiber lot is separately determined and from such entire fiber quantity there is determined, for each stored fiber lot, a partial quantity to be removed from each stored fiber lot during the first pass. Each partial quantity represents a proportion of the entire fiber quantity of the respective stored fiber lot. Thereafter, at least during the first pass, the determined partial quantity is removed from the respective stored fiber lot.

17 Claims, 6 Drawing Figures

METHOD AND APPARATUS FOR FORMING FIBER MIXTURES

BACKGROUND OF THE INVENTION

This invention relates to a method and apparatus for forming fiber mixtures from a plurality of fiber types by sequentially taking, from different fiber lots such as fiber bales, partial quantities which are small with respect to the entire quantity of the mixture.

German Laid-Open Applications (Offenlegungsschriften) Nos. 1,685,596 (to which corresponds U.S. Pat. No. 3,577,599) and 2,063,415 disclose a method according to which a plurality of fiber bales containing the same kind of fiber are positioned next to a plurality of fiber bales of another type of fiber. A carriage is moved past the fiber bales and the bale opener mounted thereon takes from each fiber type a partial quantity so that the composition of the partial quantities obtained during each pass has the desired predetermined mixture ratio. At the same time, care is taken that, in case the required individual partial quantity of one fiber type is not reached during the opening operation of one pass, the carriage does not move on to the subsequent fiber type, but is ordered to return for making up the deficiency. Although such a method is adapted for obtaining a mixture of predetermined proportions of fiber types wherein the individual proportions are in each instance taken from a plurality of fiber bales, several disadvantages are involved with this method. The individual fiber bales even of the same fiber type have fluctuating dimensions, compressions and weights. According to the method, such an amount of fiber material is removed each time from a plurality of fiber bales of one fiber type until a quantity corresponding to the intended proportion is reached. Thus, during each pass of the carriage (on which the opener is mounted), from a plurality of fiber bales of one fiber type a predetermined quantity has to be removed or has to be complemented, while the quantities remaining in the fiber bales are not taken into account at all. As a result, it is unavoidable that in the individual fiber bales eventually residual fibers remain which disturb to a substantial extent the rhythm of operation, since they have to be processed separately, thus requiring undesirable additional labor and expense. It is a further disadvantage that a partial quantity is always taken from a plurality of fiber bales, so that the mixture can be obtained only in steps and therefore it cannot be optimally homogeneous.

SUMMARY OF THE INVENTION

It is an object of the invention to provide an improved method of the above-outlined type from which the discussed disadvantages are eliminated, thus ensuring that the opening of all fiber bales is effected without fiber residuals and further, that an optimally homogeneous mixture is obtained.

This object and others to become apparent as the specification progresses, are accomplished by the invention, according to which, briefly stated, at each stored fiber lot, prior to the first pass or prior to each pass of the bale opener, the entire momentary quantity of the stored fiber lot (fiber bale) is measured and, from the measurements, a certain partial quantity is determined which corresponds to a predetermined proportion of the momentary entire quantity and further, the determined partial quantity is continuously removed only from the measured fiber lot.

Thus, in contradistinction to the known process, only a single fiber bale is provided for each fiber type; further, the measuring is effected directly at the location of fiber opening. Thus, according to the invention, before each opening pass, the fiber bales are individually measured, the partial quantity is calculated and then, from each fiber bale only the respective calculated fiber quantity is removed during the pass. These partial quantities are taken off the fiber bales in sequence in a predetermined number of bale opening passes. Thus, as from each fiber bale of one series the calculated partial quantity is sequentially removed in one pass, the operation is repeated in the same manner during the successive pass. It is essential that the partial quantity corresponds to a predetermined proportion of the momentary entire quantity of the fiber bale. In this manner all fiber bales are opened without fiber quantities remaining. During the last pass in each instance the last partial fiber quantity remaining in each fiber bale is processed. It is an advantage of the method according to the invention, that for each pass the partial quantity is determined anew for each fiber bale. If, in practice, instead of the determined partial quantity, a larger or smaller partial quantity is removed, such a deviation can be corrected during the next pass because, in any event, a new calculation is effected. It is a further advantage that during each pass, from each fiber bale only a single partial quantity is removed. In this manner, during each pass a finely dosed mixture of the same composition can be formed from as many components as there are fiber bales to be processed.

According to a further feature of the method according to the invention, at each fiber storage site, prior to fiber removal, the initial total fiber quantity is measured and then, from the measurements a predetermined partial quantity is calculated which corresponds to a predetermined proportion of the initial total quantity and further, the determined partial quantity is removed continuously only from the measured stored fiber lot.

According to the invention, thus only the initial total quantity of each fiber bale is measured and a constant partial quantity is calculated once. These partial quantities are removed from the fiber bales in succession in a fixed number of passes. This method is particularly adapted for making mixtures of throughout constant quantity proportions.

It is a further disadvantage of the known processes that no time period is set for the removal of the individual quantity proportions. The bale opener mounted on the carriage removes fiber material from each fiber lot until the intended quantity is reached. While during one particular pass, the desired quantity may be reached immediately, it can happen that during another pass, the carriage has to be returned to remove additional material. This results in delays which means that although equal quantities are fed to an after-connected charging device for a further processing apparatus, for example, a reserve hopper of a tuft-feeding device for a carding machine, the periods of delivery are not uniform. Risks are particularly high that, because of the delays, the bale opener delivers less fiber tufts than what the after-connected machines can process, resulting in a wasteful idle run of such machines. For avoiding this disadvantage, according to a preferred embodiment of the method according to the invention, the partial quantity from each stored fiber lot is removed not later than by the end of a predetermined period. In this manner a determined time schedule can be maintained in the opening of the fiber bales. A supply of the after-connected processing machines with fiber tufts can be ensured by coordinating the output rate of the bale opener with that of the after-connected processing machines, thus preventing the latter from running idle. In this manner the opening of the fiber bales can be effected within a predetermined period.

Preferably, the fiber removal from the stored fiber lot can be accelerated to ensure that the partial quantities are removed not later than the lapse of the predetermined period.

The invention further relates to an apparatus for performing the above-outlined method according to the invention. The apparatus includes a bale opener for removing fibers from the various stored fiber lots, as well as a quantity measuring device associated with the opener and a control device which controls the mode of operation of the opener as a function of the signals transmitted by the quantity measuring device.

The bale opener may be, for example, a plucker, a stripper roll, a spiked apron or a picker. As a quantity measuring device there may be used a frequency counter or a weighing device known by themselves. The quantity measuring device is preferably a height-measuring arrangement which effects a simple and accurate determination of the partial fiber quantities to be removed from the bales. The quantities removed or to be removed can be determined in a simple manner as a function of the height of the fiber bale. The height-measuring device may comprise, for example, a light barrier or an electromechanically operating sliding potentiometer.

Expediently, the quantity measuring device is movable with the bale opener along the stored fiber lots (fiber bales) so that measurements can be taken directly at the location of fiber removal. The opening device may operate in a discontinuous manner by moving vertically up and down or may be displaceable in any other known manner.

Preferably, the control arrangement has a control apparatus and a computer; the control arrangement determines the precise partial quantities to be removed and also, controls the fiber removing operation. It is expedient to provide the control device with a timing relay which predetermines a maximum period to ensure that the partial quantity from each stored fiber lot is removed not later than at the end of the predetermined period.

The control apparatus has, among others, the function of controlling the displacement of the transporting device (carriage) on which the bale opener is mounted. For this purpose, an output of the control apparatus is connected with the drive of the carriage. For positioning and starting the carriage, preferably switch contacts are provided which too, are connected with the control apparatus. Expediently, for reversing the direction of operation of the bale opener, there are provided two limit switches which are connected with an input of the control apparatus. These limit switches have the advantage that the control apparatus receives a signal immediately as a pass is completed; in this manner the number of passes remaining is reduced by one.

The control apparatus further has the additional function of controlling the beginning and the end of the bale opening operation regarding the removal of the partial fiber quantity. For this purpose, the control apparatus is connected with the drive of the bale opener. The control apparatus maintains the drive motor of the opener energized until the partial quantity is removed from the bale. As a starting signal one may use, for example, the signal emitted by the switch contacts of the carriage. The signal for stopping the motor is derived by the control apparatus from a signal which, in turn, is generated by the quantity measuring device and the computer and is transmitted when the predetermined partial quantity has been removed. This signal can, at the same time, be used as the signal for commanding the carriage to continue its travel.

Preferably, the drive of the bale opener is a pole-reversible electromotor which accelerates the operation of the bale opener if, for example, in case of particularly hard (compressed) bales, the partial quantity is not removed within the predetermined period.

DESCRIPTION OF THE PREFERRED EMBODIMENTS

For performing the method according to the invention, there are provided a fiber removing apparatus, a quantity measuring apparatus and a control apparatus which controls the mode of operation of the fiber removing apparatus. The fiber removing apparatus as well as the quantity measuring apparatus may be of any selected type.

Figure 1:
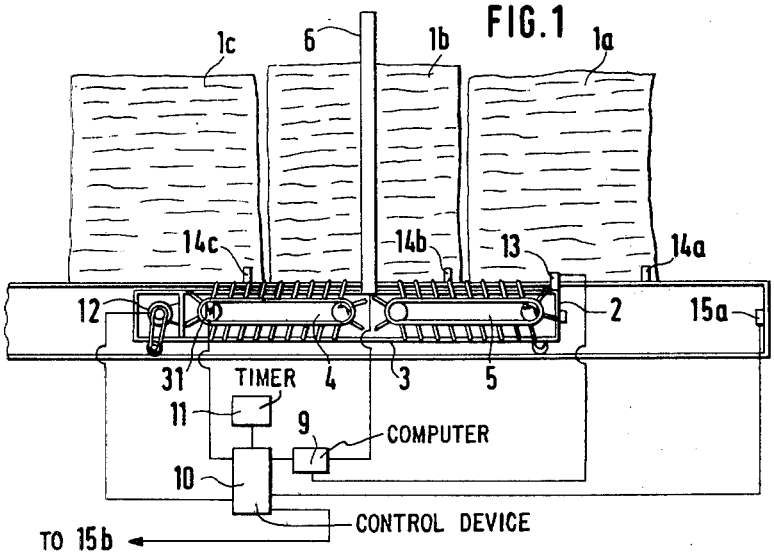
FIG. 1 is a schematic side elevational view of a preferred embodiment of the invention.
Figure 2:
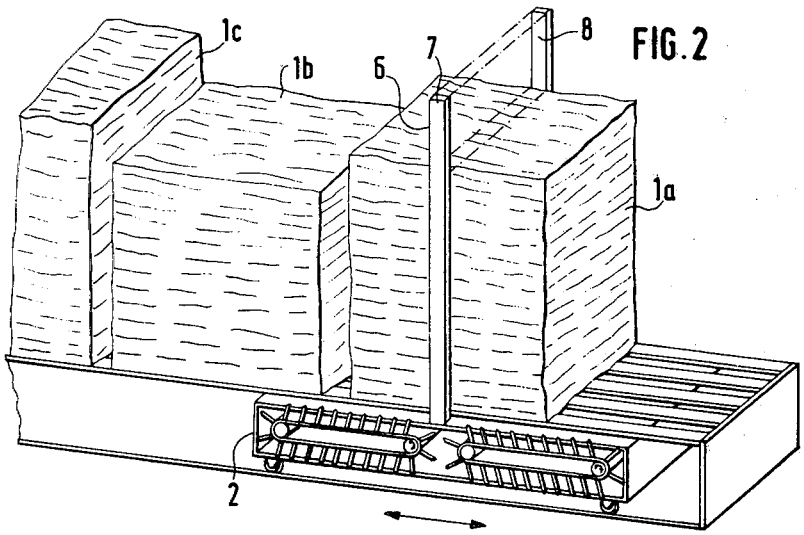
FIG. 2 is a schematic perspective view of the structure shown in FIG. 1.

Turning now to FIGS. 1 and 2, in a preferred embodiment of the apparatus according to the invention, a series of textile fiber bales 1*a*, 1*b* and 1*c* are arranged side-by-side on a bale support, under which travels a carriage 3 on which there are mounted two spiked fiber bale opener aprons 4, 5, constituting a fiber removing apparatus 2. On the carriage 3 there is laterally mounted a height-measuring device 6 which constitutes a fiber quantity measuring apparatus and which is, in essence, a light barrier formed of a light transmitter 7 and a light receiver 8. The upper ends of the light barrier project upwardly beyond the maximum expected height of the fiber bales. The receiver 8 of the height-measuring device 6 is connected, by the intermediary of a computer 9, with an input of a control device 10 coupled to a timer 11. An output of the control device 10 is connected with a drive motor 12 of the carriage 3. At one end, the carriage 3 has a switching element 13 which consecutively engages contacts 14*a*, 14*b* and 14*c*, laterally mounted on the machine frame at bales 1*a*, 1*b* and 1*c*, respectively. The switching element 13 is coupled with an input of the control device 10 so that as the bale opener 2 reaches its starting position, a signal is applied to the control device 10. The signal starts the measuring process, the displacement of the carriage 3 as well as the rotation of the breaker aprons 4 and 5. The switching contacts 14*a*, 14*b* and 14*c* may also be utilized for reversing the drive of the carriage 3 in case the determined partial quantity is removed from the bales continuously by several back-and-forth passes. In such a case, the switching element 13 transmits a reversing signal to the control device 10 as the switching element 13 engages one of the switching contacts 14*a* or 14*b*, respectively. At each of the two ends of the bale support (only one end shown in FIGS. 1 and 2) there are provided limit switches 15*a*, 15*b*, respectively, which are connected with inputs of the computer 9 and which are actuated by the carriage 3. The control device 10 has an output which is connected with a pole-reversible drive motor 31 of the breaker aprons 4, 5.

Figure 3:
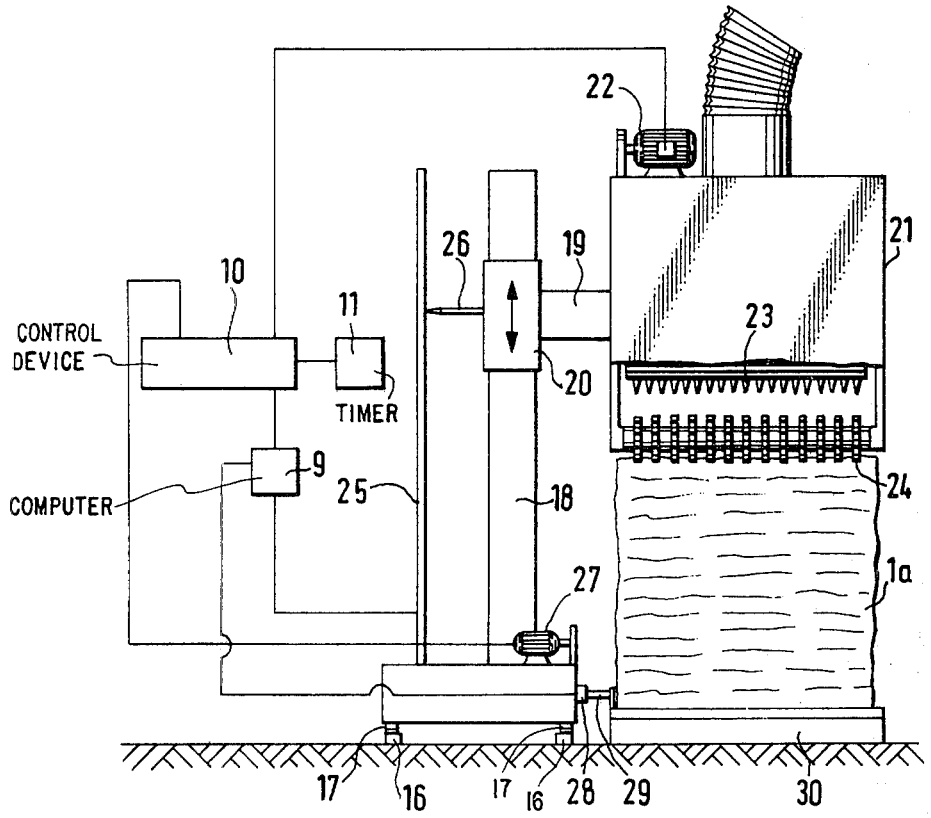
FIG. 3 is a schematic front elevational view of another preferred embodiment of the invention.

Turning now to the front elevational FIG. 3, in another preferred embodiment shown therein, the apparatus according to the invention has a fiber removing apparatus which opens the fiber bales from above and which has an electromechanical height-measuring device. The fiber bales (of which only bale 1*a* is visible in FIG. 3) are positioned on a platform 30 supported on the floor. Adjacent the platform 30 there are provided rails 16 on which a vertical stand 18 may travel by means of rollers 17, propelled by a motor 27. A horizontal support arm 19 is height-adjustably mounted on the stand 18 by means of a securing member 20. The support arm 19 carries a bale opener 21 adapted to engage each fiber bale on the top. A motor 22 drives, in a manner not shown, an opening roll 23 as well as delivery rolls 24 of the bale opener, as seen in more detail in FIG. 4. Parallel to the stand 18 there is arranged a vertical measuring device 25 which, in essence, is formed of a sliding potentiometer. The vertically displaceable securing member 20 is coupled by means of a contact member 26 with the measuring element 25, so that a displacement of the securing element 20 is a measure for the change of height of the bale opener 21 and thus is a measure of the height of the removed fiber quantities. The fiber removing operation performed by the bale opener 21 may be time-controlled and quantity-controlled. Consequently, after the lapse of a predetermined period or upon reaching a predetermined tuft quantity, the bale opener is lifted off the fiber bale which has just undergone opening and is moved to an adjacent fiber bale and is then lowered to resume the opening operation. In this manner a programmed fiber removal can be effected, that is, a predetermined quantity of fine fiber tufts can be obtained in a predetermined mixture ratio in a predetermined time period for further processing, for example, in a cleaner. The control described in connection with the embodiment shown in FIGS. 1 and 2 may find application in the arrangement of FIG. 3 as well. After removing the predetermined partial quantity, the support arrangement 18, 19 and 20 with the bale opener 21 is, as commanded by the control device 10, displaced to the adjacent fiber bale. At the foot of the stand 18, there is mounted a switch 28 which is oriented towards the fiber bales and which is connected with an input of the computer 9. The switch 28 engages electric switch contacts 29 (only one shown) associated with each fiber bale and mounted laterally on the platform 30. The reversal of the operation of the fiber removing apparatus 21 at the end of the fiber bale series can be effected by the actuation of a limit switch as described in connection with the embodiment shown in FIG. 1. As an alternative, it is feasible to initially set the number of the fiber bales at the control device 10, so that both the reversal of the fiber removing apparatus 21 and the reduction of the number of passes by one are performed automatically.

Figure 5:
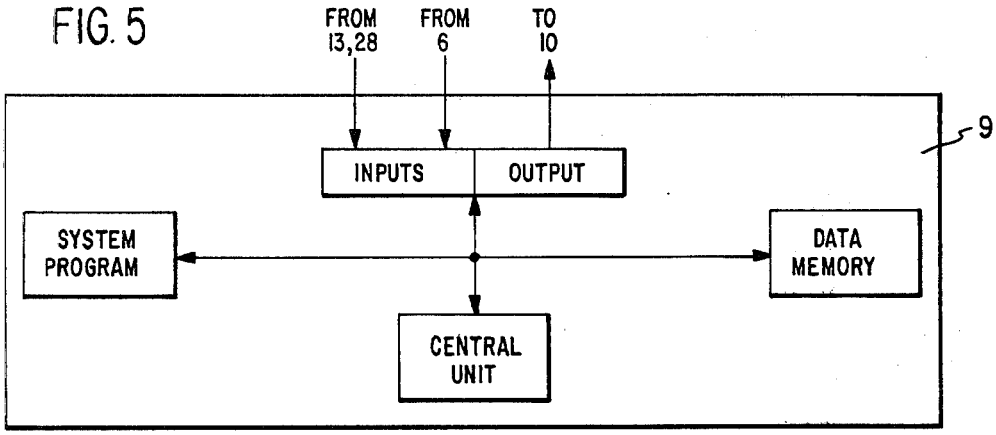
FIG. 5 is a block diagram of a computer used in the apparatus according to the invention.

Turning now to FIG. 5, there is illustrated the relationship between principal components of, for example, a commercially available microcomputer 9. The computer has inputs, for example, to receive signals from the switching element 13 and the height measuring device 6 as well as an output, for example, to apply signals to the control device 10. The microcomputer 9 conventionally includes a unit for the system program, a central unit (CPU) and data memories, all interconnected in a known manner.

The essential function of the microcomputer 9 resides in continuously counting the electrical pulses emitted by the light barrier 6, in determining the actual height of the fiber bale from a comparison with the original height and in emitting appropriate instructions to the control device 10 for the motors 12 and 31.

Figure 6:
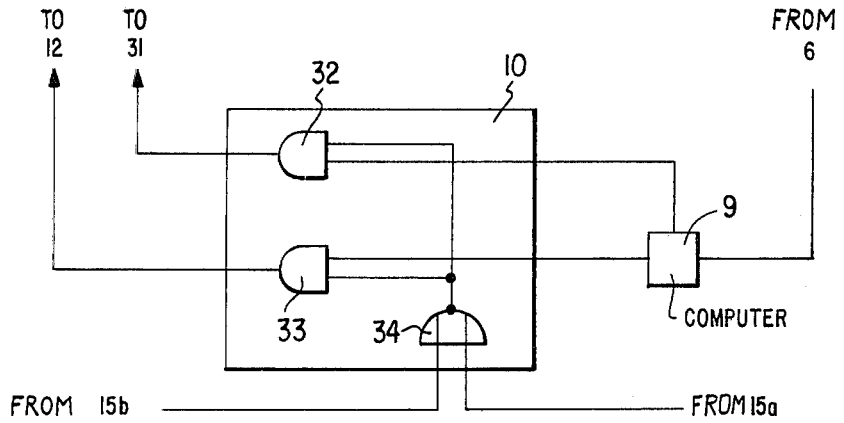
FIG. 6 is a circuit diagram of a component shown in FIG. 1.

Turning now to FIG. 6, there is schematically shown the logic circuit for the inputs and outputs of the control device 10 which may be a commercially available programmable control. The control circuit includes a NOR gate 34, the two inputs of which receive signals from the respective limit switches 15*a* and 15*b*. The output of the NOR gate 34 is connected to an input of AND gates 32 and 33, whose other input, in turn, receives signals from the computer 9. The output of the AND gate 32 is connected to the motor 31 whereas the output of the AND gate 33 is connected to the motor 12.

A fixed program is fed into the control device 10 which, based on this program and upon the actual instructions from the computer 9, controls the motors 12 and 31.

The method according to the invention will be described in three examples which follow.

EXAMPLE 1

It is assumed that twenty fiber bales of significantly different initial heights are to be opened by the arrangement illustrated in FIGS. 1 and 2. It is desired that each fiber bale should be fully opened in the course of 100 passes. For the fiber removal during the first pass, the fiber removing apparatus 2 moves, with the height-measuring device 6, under the first fiber bale 1*a*. First, however, the total height of the fiber bale 1*a* is measured. The light transmitter 7 and the receiver 8 of the light barrier are 200 cm tall. The light source of the transmitter 7 radiates light over the entire height of 200 cm; of this light, one part impinges on the fiber bale 1*a* and another part, for example 10 cm, reaches the photocells of the receiver 8. As a response, the receiver 8 applies electric signals to the computer 9 which determines that the total height of the fiber bale 1*a* is 190 cm. Since the fiber removal is to be performed in the course of 100 passes, for the first partial quantity removal, a height of 1.9 cm is determined. After 1.9 cm has been removed from the total height of 190 cm in the first pass, the fiber removing apparatus moves on to the next fiber bale 1*b* where, in the same manner, a predetermined partial quantity is set and subsequently removed. Thus, the fiber removing apparatus 2 moves onto the adjoining fiber bale only when the entire determined partial quantity has been removed from the previous bale. At the end of the bale series, after the determined partial quantity is removed from each fiber bale, the number of passes still to be performed is reduced by one to ninety-nine.

The Table at the end of the Examples indicates for each fiber bale the individual total height before fiber removal, the fiber quantity to be removed and the individual total height after removal.

TABLE

| | Fiber Bale No. 1 | | | Fiber Bale No. 2 | | |
|---|---|---|---|---|---|---|
| | Total height prior to removal of partial quantity, in cm | Partial quantity to be removed, in cm | Total height after removal of partial quantity, in cm | Total height prior to removal of partial quantity, in cm | Partial quantity to be removed, in cm | Total height after removal of partial quantity, in cm |
| 1st pass | 190 | $\frac{190}{100} = 1.9$ | 188.1 | 200 | $\frac{200}{100} = 2$ | 198 |
| 2nd pass | 188.1 | $\frac{188.1}{99} = 1.9$ | 186.2 | 198 | $\frac{198}{99} = 2$ | 196 |
| 3rd pass | 186.2 | $\frac{186.2}{98} = 1.9$ | 184.3 | 196 | $\frac{196}{98} = 2$ | 194 |
| 4th to 99th pass | | | | | | |
| 100th pass | | | zero | | | zero |

| | Fiber Bales No. 3 to 19 | Fiber Bale No. 20 | |
|---|---|---|---|
| | Total height prior to removal of partial quantity, in cm | Partial quantity to be removed, in cm | Total height after removal of partial quantity, in cm |
| 1st pass | 170 | $\frac{170}{100} = 1.7$ | 168.3 |
| 2nd pass | 168.3 | $\frac{168.3}{99} = 1.7$ | 166.6 |
| 3rd pass | 166.6 | $\frac{166.6}{98} = 1.7$ | 164.9 |
| 4th to 99th pass | | | |
| 100th pass | | | zero |

EXAMPLE 2

Figure 4:
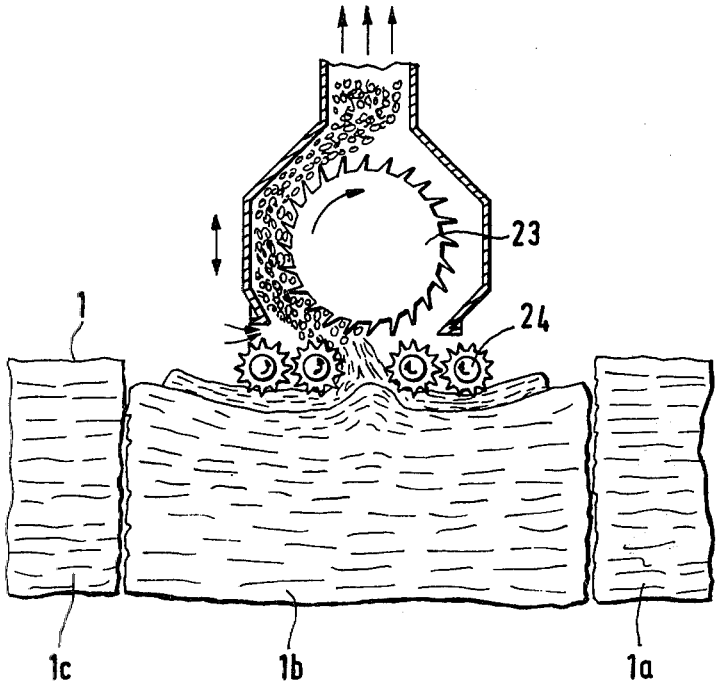
FIG. 4 is a sectional side elevational view of a detail of the structure illustrated in FIG. 3.

This example, which is discussed in conjunction with the apparatus illustrated in FIGS. 3 and 4, generally corresponds to Example 1; the partial quantity, however, is removed from each bale not later than at the end of a predetermined period. For the removal of a partial quantity from the fiber bale 1*a*, the control device 10 is set by the timer 11 for a removal period of 0.5 minutes in addition to the total height of 1.9 cm to be removed. The fiber removing apparatus 21 removes fiber from the first fiber bale 1*a* for a certain period, for example 0.25 min. Thereafter, the actual height is determined and, by means of the computer 9, there is performed a comparison between the desired quantity to be removed and the quantity actually removed. If after ½ of the predetermined period, that is, after 0.25 min., the first half of the partial quantity to be removed, that is, 0.95 cm has been reached, the second half is removed with the same speed as the first half. If, however, after the first half of the predetermined period, one half of the material to be removed has not yet been reached, that is, less than 0.95 cm was removed, the control device emits an electric signal to the drive motor 22 to accelerate its rotation so that the rolls 23 and 24 will effect a faster removal of fiber from the fiber bale 1*a*.

EXAMPLE 3

It is feasible to set, for the different fiber bales 1*a*, 1*b*, etc., different fiber removal periods for the partial quantity, for example, in each instance a period between 0.5 min. and 2 min. This means, for example, that the partial quantity must be removed from the fiber bale 1*a* not later than in 0.5 min., from the fiber bale 1*b* not later than in 1 min. and from the fiber bale 1*c* not later than in 0.75 min.

It is to be understood that the above description of the present invention is susceptible to various modifications, changes and adaptations, and the same are intended to be comprehended within the meaning and range of equivalents of the appended claims.

What is claimed is:

1. In a method of forming fiber mixtures from different kinds of fiber, including the step of removing the fiber in a plurality of passes from a plurality of stored fiber lots containing the different kinds of fiber, wherein during each pass fiber is removed from consecutive stored fiber lots in partial quantities that are small relative to the entire fiber quantities in the stored fiber lots; the improvement comprising the following steps:

(a) separately determining, prior to fiber removal in the first pass, the entire fiber quantity in each stored fiber lot;

(b) separately determining for each stored fiber lot, prior to fiber removal in the first pass, a partial quantity to be removed from each stored fiber lot during the first pass, each said partial quantity representing a proportion of the entire fiber quantity of the respective stored fiber lot; and (c) removing, at least during the first pass, the determined partial quantity from the respective stored fiber lot.

2. A method as defined in claim 1, wherein the removing step comprises the step of removing said determined partial quantities from the respective stored fiber lots in each pass.

3. A method as defined in claim 2, wherein said removing step further comprises the step of removing each partial quantity by the end of a predetermined period.

4. A method as defined in claim 3, further comprising the step of regulating the speed of fiber removal for obtaining the predetermined partial quantity during said predetermined period.

5. A method as defined in claim 1, wherein the partial quantities determined prior to the fiber removal in the first pass are removed solely during said first pass; the improvement further comprising the following steps:

(d) subsequent to the first pass and prior to the fiber removal in each consecutive pass, separately determining the entire fiber quantity of the respective stored fiber lots remaining after the fiber removal in each preceding pass;

(e) subsequent to the first pass and prior to the fiber removal in each consecutive pass, separately determining for each stored fiber lot a partial quantity to be removed from each stored fiber lot during the next pass, each partial quantity determined after the first pass and prior to fiber removal in each consecutive pass representing a proportion of the entire fiber quantity of the respective stored fiber lot remaining after the respective preceding pass; and (f) removing, during each pass subsequent to the first pass, the partial quantity from the respective stored fiber lot, as determined immediately prior to the fiber removal of the respective pass.

6. A method as defined in claim 5, wherein steps (c) and (f) further comprise the step of removing each partial quantity by the end of a predetermined period.

7. A method as defined in claim 6, further comprising the step of regulating the speed of fiber removal for obtaining the predetermined partial quantity during said predetermined period.

8. In an apparatus for forming fiber mixtures from different kinds of fiber contained in different stored fiber lots; the apparatus including support means for positioning the fiber lots in a series and a fiber removing device traveling along the support means for removing consecutively from each fiber lot partial quantities in a plurality of passes; the improvement comprising (a) a quantity measuring means for separately determining the entire fiber quantity of each stored fiber lot prior to fiber removal during the passes; and (b) control means coupled to said quantity measuring means and said fiber removing device for determining, for each stored fiber lot, a partial quantity from the entire quantity determined by said quantity measuring means and for controlling said fiber removing device dependent upon the partial quantities.

9. An apparatus as defined in claim 8, wherein said quantity measuring means includes a height-measuring device.

10. An apparatus as defined in claim 8, further comprising means for moving said fiber removing device and said quantity measuring means as a unit along said support means.

11. An apparatus as defined in claim 8, wherein said control means includes a control device and a computer; said computer having an input connected to said quantity measuring means for receiving signals therefrom and an output connected to an input of said control device for applying signals to said control device; said control device having an output connected to said fiber removing device for controlling the operation thereof.

12. An apparatus as defined in claim 11, wherein said control means further includes a timer having an output connected to an input of said control device.

13. An apparatus as defined in claim 11, further comprising limit switches arranged at each longitudinal end of said support means and connected to an input of said control device for applying signals thereto to reverse the operation of said fiber removing device.

14. An apparatus as defined in claim 11, further comprising transport means for displacing said fiber removing device along said support means, and drive means for propelling said transport means; said control device having an output connected to the drive means of said transport means.

15. An apparatus as defined in claim 14, further comprising electric contact means arranged along said support means and connected to an input of said control device; actuating means carried by said transport means for cooperating with said electric contact means for positioning and starting said transport means.

16. An apparatus as defined in claim 11, further comprising drive means for operating said fiber removing device; said control device having an output connected to said drive means.

17. An apparatus as defined in claim 16, wherein said drive means comprises a pole-reversible electric motor.

* * * * *